US007264324B2

(12) United States Patent
Kovacs

(10) Patent No.: US 7,264,324 B2
(45) Date of Patent: Sep. 4, 2007

(54) METHOD AND APPARATUS WITH VERNIER TECHNIQUE FOR REGISTRATION OF EJECTOR MODULE

(75) Inventor: Gregory J. Kovacs, Webster, NY (US)

(73) Assignee: Xerox Corporation, Stamford, CT (US)

( * ) Notice: Subject to any disclaimer, the term of this patent is extended or adjusted under 35 U.S.C. 154(b) by 276 days.

(21) Appl. No.: 11/013,704

(22) Filed: Dec. 17, 2004

(65) Prior Publication Data

US 2006/0132519 A1 Jun. 22, 2006

(51) Int. Cl.
*B41J 29/38* (2006.01)

(52) U.S. Cl. ..... 347/12; 347/42; 347/43

(58) Field of Classification Search ..... 347/9–13, 347/40–43, 19; 358/1.8
See application file for complete search history.

(56) References Cited

U.S. PATENT DOCUMENTS 5,801,727 A 9/1998 Torpey ..... 347/40
5,809,375 A 9/1998 Owens, Jr. et al. ..... 399/111
6,705,697 B2 3/2004 Audi et al. ..... 347/13
2002/0140954 A1* 10/2002 Silverbrook et al. ..... 358/1.8
2005/0122354 A1* 6/2005 Yamane et al. ..... 347/11

* cited by examiner

*Primary Examiner*—Stephen Meier
*Assistant Examiner*—Lam S. Nguyen
(74) *Attorney, Agent, or Firm*—Oliff & Berridge, PLC

(57) ABSTRACT

Alignment of an ejector module in a printhead is achieved along a lateral direction by arranging first and second partially overlapping pluralities of nozzles, determining an alignment pair between first and second nozzles within their respective pluralities, and assigning the alignment pair as boundaries for print actuation. The first and second ejector modules are disposed in a printhead array along a lateral direction and include first and second nozzles eject fluid on command. The first nozzles are disposed with a first spacing therebetween in the first ejector module. The second nozzles at one end of the second ejector module that overlap the first nozzles are disposed with a second spacing that differs from the first spacing. An alignment pair between first and second nozzles of their respective pluralities is determined to minimize an alignment spacing between each other as compared to remaining nozzles. The first and second alignment nozzles are assigned as first and second boundaries for print actuation.

17 Claims, 4 Drawing Sheets

METHOD AND APPARATUS WITH VERNIER TECHNIQUE FOR REGISTRATION OF EJECTOR MODULE

BACKGROUND OF THE INVENTION

1. Field of Invention

This invention relates to devices and methods directed to aligning a printhead ejector module by a vernier technique.

2. Description of Related Art

The photocopier industry modularizes a variety of consumable components as replaceable and disposable cartridges, categorized by function, employed in the photocopier machine. Each of these cartridges to be inserted or removed from the machine constitutes a replaceable module, also known in the industry as a customer replaceable unit (CRU), for example, described in U.S. Pat. No. 5,809,375 to Owens, Jr. et al.

The photocopier industry employs inkjets as ejector modules disposed in a full-width array (FWA) print bar, for example, described in U.S. Pat. No. 5,801,727 to Torpey. The ejector modules receive fluid ink from a reservoir (typically a tank module) through a manifold. Various ejector modules employ a variety of techniques for releasing controllable quantities of ink onto a medium, including thermal inkjets (TIJ), piezoelectric inkjets (PIJ) and micro-electro-mechanical-system inkjets (MEMSJet). In particular, TIJ ejector modules are manually replaceable by the user. The ink is ejected through nozzles onto the medium upon command, but is otherwise retained within the ejector module by surface tension and by differential pressure, whereby the internal ejector pressure can be lower than ambient to which the ink is exposed.

SUMMARY OF THE INVENTION

A major concern for the use of FWA print bars in single pass printing applications is that jet failure causing unacceptable image quality defects would require very expensive replacement of the entire print bar. This concern applies to almost any ejector technology including TIJ, MEMSJet or PIJ. Replacement of a smaller module containing the defective nozzles is more cost effective, especially if the customer could be perform this task in just a few minutes, without sophisticated and expensive alignment hardware.

Various implementations enable an inexpensive replaceable module strategy that allows rapid and convenient replacement by the customer of a relatively small module containing defective nozzles. This enables FWA print bars to be maintained at low cost in the field without the need for any sophisticated and expensive alignment hardware. Thus, various implementations enable high throughput single pass printing at low cost.

An ejector module may suffer degraded performance from nozzle clogging or other such defects that cause unacceptable image quality. Print defects include image streaks caused by (a) misaligned nozzles in adjacent staggered printhead modules, and (b) missing nozzles due to premature statistical failure. Hence, the ejector module may require periodic maintenance and/or replacement with a fresh ejector module to avoid overhauling the entire FWA print bar. After replacing an ejector module, precision placement of the replacement module must be performed, often at the assembly factory.

In order to maintain print quality and avoid image streaks caused by misaligned ejectors, the replacement ejector module must be aligned with the other ejector modules in the FWA print bar. Current techniques require sensitive alignment detection and precise actuation to control placement of the replacement ejector module.

These precision detectors and actuation drives are expensive and the cost becomes prohibitive if a large number of relatively small modules ~1" in size must be accurately positioned. With ~1" modules, up to twelve precision drives may be required to cover typical printing widths for only a single color. Printing with four colors would quadruple the cost of these precision drives.

Various implementations of this invention provide cost effective solutions for eliminating image streaks caused by (a) misaligned jets in adjacent staggered printhead modules, and/or (b) missing jets due to premature statistical failure. These solutions are (1) reducing misalignment to $\leqq 10$ μm through the vernier effect with slightly larger (smaller) nozzle spacing at the end of each module, and/or (2) employing single pass checker-boarding and implement a replaceable module strategy enabled by vernier effect alignment.

The systems, devices and methods described herein are intended to overcome the need for factory module replacement and/or for expensive precision drives for in situ module alignment. The implementations described herein are designed to enable a strategy for high print quality by providing a method for achieving alignment of the image bearing nozzles in a narrow overlap region between two replaceable ejector modules.

When a replaceable ejector module is replaced the nozzles in the new module will be in some displaced position relative to the nozzles in the adjacent modules. The vernier effect may be used to achieve alignment of the nozzles in the replaced module relative to those in overlapping adjacent modules. The last few nozzles at one end of any module may be made at a slightly larger (or smaller) spacing than the nominal jet spacing, thereby enabling a position to be identified in which the nozzles of both overlapping modules are very closely aligned. The corresponding drop sizes may also be made slightly larger (or smaller) to compensate for the change in spacing.

Various implementations of this invention provide apparatuses, systems and methods for aligning an ink jet module in an FWA print bar for proper installation by applying a vernier technique that uses moderately different nozzle spacing between adjacent overlapping modules. In the context of this disclosure, the spacing difference is considered moderate for difference values no greater than one-half the nominal spacing between nozzles in an ejector module.

In particular, aligning an ejector module in a printhead array along a lateral direction, may be achieved by arranging a first plurality of nozzles within a first module, the first plurality including a first spacing between adjacent first nozzles along the lateral direction, arranging a second plurality of nozzles at one end of a second module, the second plurality including a second spacing between adjacent second nozzles that differs moderately from the first spacing along the lateral direction, the second plurality partially overlapping the first plurality in the lateral direction at the one end, determining an alignment pair between a first alignment nozzle of the first plurality and a second alignment nozzle of the second plurality, the first and second alignment nozzles minimizing an alignment spacing between each other as compared to remaining nozzles of the first and second pluralities, and assigning the first and second alignment nozzles as first and second boundaries for print actuation.

Various implementations of this invention further provide the second spacing to be alternatively larger or smaller than the first spacing. Various implementations of this invention further provide corresponding nozzle sizes in which the second nozzles are larger or smaller than the first nozzles, corresponding to their relative spacings. The drop size may be correspondingly adjusted, for example, by the adjustment in nozzle size, so as to properly fill in a pixel area corresponding to a particular nozzle spacing.

Various implementations of this invention further provide printing first and second lines from the first and second plurality of nozzles, respectively, comparing distances between pairs of adjacent first and second lines, and selecting a pair of the adjacent lines having a minimum distance therebetween.

BRIEF DESCRIPTION OF THE DRAWINGS

Various implementations of this invention are described in detail with reference to the following figures, wherein.

DETAILED DESCRIPTION

The following detailed description of the replaceable ejector modules usable with printing systems or other technologies that print documents refer to a particular type of printhead system, e.g., an inkjet printer that uses the ejector modules, for sake of clarity and familiarity. However, it should be appreciated that the principles described herein can be equally applied to any known or later-developed printing systems.

Various implementations of this invention are intended to overcome the need for factory module replacement and/or for expensive precision drives needed for module alignment in situ by the customer. Various implementations enable a simple replaceable ejector module strategy by providing a method for achieving alignment of the image bearing nozzles in a narrow overlap region between two ejector modules (or alternatively chips).

When a replaceable ejector module is replaced, the nozzles in the new module will be in some displaced position relative to the nozzles in the adjacent modules. The vernier effect can be used to achieve alignment of the nozzles in the replaced module relative to those in the adjacent modules. The last few nozzles at one end of any module may be made at a slightly larger (or smaller) spacing than the nominal jet spacing. The corresponding drop sizes may also be made slightly larger (or smaller) to compensate for the change in spacing, for example, by slight enlargement or reduction of nozzle sizes.

The nozzle spacings and drop sizes can all be accurately controlled by photolithographically generated features of the ejectors, enabling the structure to be readily manufacturable. When the last few nozzle spacings in the vernier end of one module are slightly larger (or smaller) than the nozzle spacings in the adjacent overlapping module, a position can readily be found where the nozzles in both modules are very closely aligned. The image bearing nozzles may then be chosen from each module to achieve a transition in the active nozzles from one module to the next with the desired degree of alignment. The ejector technology in each replaceable module could be any of TIJ, MEMSJet, PIJ or other applications.

Figure 1:
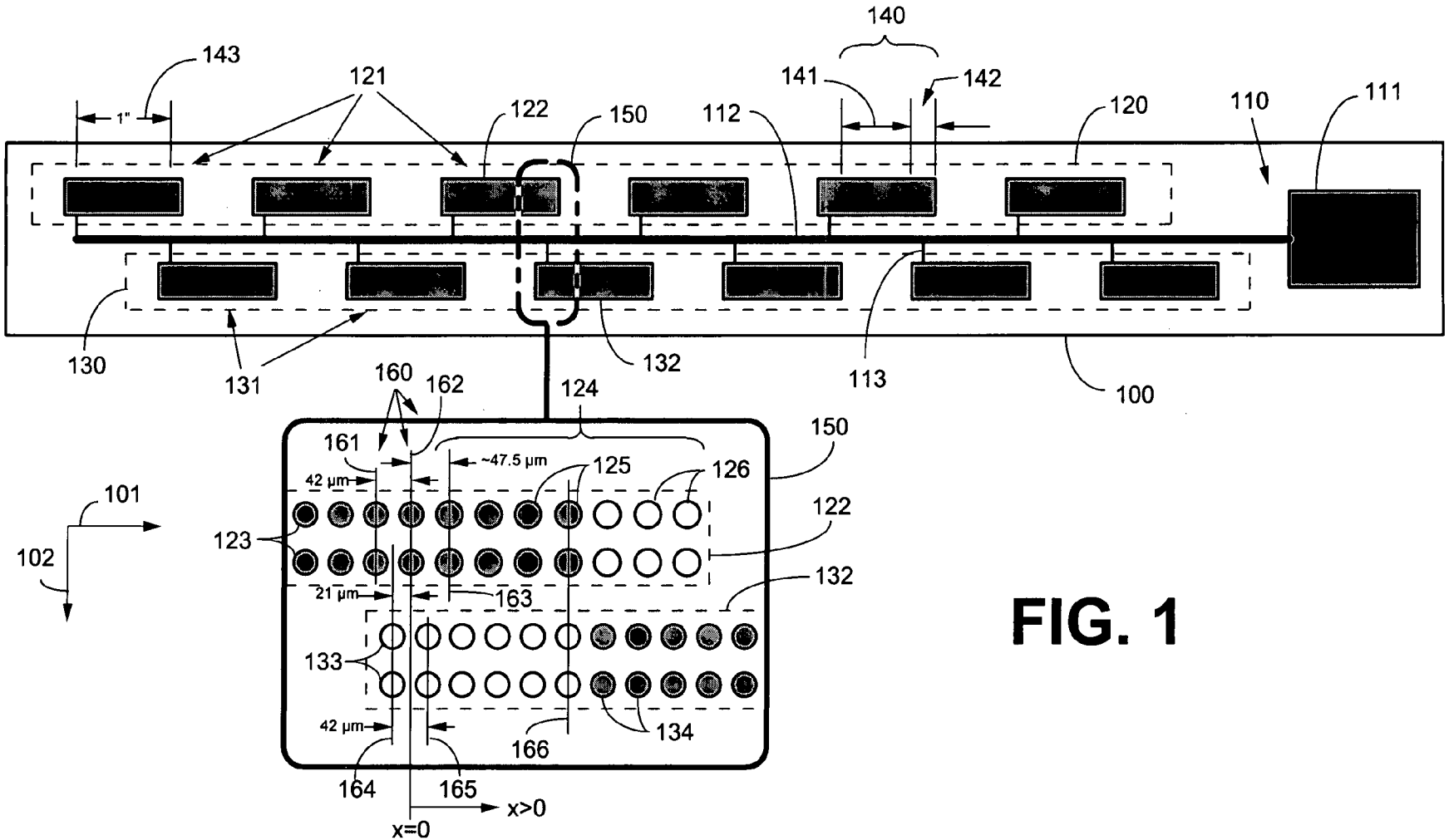
FIG. 1 shows an exemplary FWA with detail region of a nozzle configuration.

FIG. 1 shows an exemplary structure for an FWA print bar 100 oriented longitudinally in a lateral direction 101 across the width of a medium to be printed. The medium translates in a transverse or process direction 102 for processing. A fluid ink feed system 110 provides ink from an ink tank or reservoir 111. The ink is conducted through a manifold that includes an umbilical 112 and a series of feed passages 113 to the ejectors that deposit ink onto the medium. The ejectors may be arranged in a row pair of printhead ejectors that includes an upstream row 120 and a downstream row 130.

The upstream row 120 includes a first series of upper ejector modules 121. Similarly, the downstream row 130 includes a second series of lower ejector modules 131. Each of these ejector modules 121 and 131 may be replaceable within the FWA print bar 100. The rows 120 and 130 extend across a periodically repeatable width 140 across the medium. The repeatable width 140 may be subdivided as a non-overlapping region 141, in which only a single ejector module from a single row provides ink deposition coverage in the lateral direction 101, and an overlapping region 142, in which ejector modules from both rows can alternately deposit ink onto the medium. Each ejector module may have an effective lateral coverage region 143, for example, of about one inch (1") in width.

The upstream and downstream rows 120 and 130 may be arranged to enable the printer to eject ink along the lateral direction 101 across the entire width of a medium, e.g., a sheet of paper, without translating the printer head. As the medium is transported across the FWA print bar 100 in the process direction 102, the ejector modules deposit ink thereon. Each of the ejector modules may print over a non-overlapping segment in the lateral direction 101 of, for example, one inch (1") in width. The ejector modules may deposit fluid ink onto the medium through a plurality of nozzles. The ink contained therein may be maintained within the ejector module by surface tension and negative differential pressure until released by piezoelectric compression or electro-resistive expansion.

The underside of the modules may include a series of ejector nozzles facing the medium. A detail region 150 shows an exemplary portion of the FWA print bar 100 for two selected overlapping ejector modules 122 and 132 from the upstream and downstream rows 120 and 130, respectively. The enlarged illustration of the detail region 150 shows the ejector nozzles (described in detail below) for the overlapping ejector modules 122 and 132. In the exemplary configuration shown in the detail region 150, the nozzles are disposed in multiple columns of two parallel nozzle rows for each module. The rows correspond at least approximately to the lateral direction, while columns correspond at least approximately to the process direction 102. Each pair of tandem nozzles along the columns is disposed to align orthogonal to their respective rows. It should be appreciated that although two nozzle rows are shown (in a double-row configuration), a single nozzle row, and more than two nozzle rows are also possible.

Single pass checker-boarding may be facilitated by adjacent nozzles of first and second rows in the double-row nozzle configuration. This can be implemented, for example, by printing solid blocks of an image by printing a first pixel with the nozzle from the first row of the double-row configuration, followed by printing a second pixel with the nozzle from the second row. Then, first and second row nozzles can print third and fourth pixels, respectively. In the event that one of these adjacent nozzles from either the first or second row prematurely fails, then every other pixel of the image in the process direction can nonetheless be printed due to the continued function of the counterpart adjacent nozzle, thereby reducing image defects from the failed nozzle to acceptable levels.

The ejector modules deposit ink onto the medium via nozzles having a size (e.g., diameter) and a spacing (between adjacent nozzle centers) between columns, as determined by design requirements. The size and spacing can be either "standard" or "vernier", which refers to either larger or smaller size and spacing from the standard. In the examples described below, the standard spacing of 42 μm corresponds to 600 nozzles per inch (npi) (or 1.0/600"), which produces a print resolution of 600 dots per inch. The vernier or enlarged spacing may be approximately 47.5 μm, corresponding in this example to a 12.5% increase. The enlarged spacing corresponds to 1.125/600" (as compared to 1.0/600"). This is considered to be a small to modest change from the standard spacing.

The upper module 122 includes image bearing or active standard nozzles 123 having a standard size and spacing disposed predominantly in its non-overlapping region 141. The last several nozzles on one end of the printhead ejector module have slightly increased (or decreased) spacing, to enable vernier alignment of nozzles from one module to the next. Thus, the upper module 122 also includes a vernier series of nozzles 124 having an extended size and spacing disposed predominantly in the overlapping region 142 at the right end of the ejector module 122.

The vernier nozzle series 124 comprises active vernier nozzles 125 and passive or inert vernier nozzles 126, which are slightly larger than the active standard nozzles 123 to compensate in ink coverage for the increased spacing. The lower module 132 includes inert nozzles 133 in its overlapping region 142 and active nozzles 134 in its non-overlapping region 141. It should be noted that the nozzle sizes and their respective spacings are not necessarily shown to scale, and that particular dimensions shown are merely exemplary. It should also be understood that the larger size and spacing of the enlarged nozzles as compared to the standard nozzles represents only an example and can represent smaller size and spacing as compared to the standard nozzles, as well.

Alignment lines 160 can be superimposed on the columns of the nozzle centers from which to determine their relative spacing. For example, first and second alignment lines 161 and 162 pass through columns in the upper ejector module 122 of an adjacent pair of active standard nozzles 123 having standard size and spacing. A third alignment line 163 passes through a column of the active vernier nozzles 125 having enlarged size and spacing. Fourth and fifth alignment lines 164 and 165 pass through columns in the lower ejector module 132 of an adjacent pair of inert nozzles 133. The spacings between the first and second alignment lines and between the fourth and fifth alignment lines are both 42 μm, while the spacing between the second and third alignment lines is about 47.5 μm. In the configuration shown, the spacing between the fourth and second alignment lines is a maximum of 21 μm.

Due to the vernier effect, the non-standard spacing of the vernier nozzle series 124 yields a sixth alignment line 166 in which a column of active vernier nozzles 125 of the upper ejector module 122 is aligned (within ≦10 μm tolerance) with a column of inert nozzles 133 of the lower ejector module 132. This enables vernier alignment of nozzles from one module to the next to reduce the misalignment of adjacent active nozzles from overlapping modules to not more than 10 μm, the accuracy needed to eliminate visible image streaks.

The sixth alignment line 166 may be arranged at or near the edge of the lateral coverage region 143 in the overlapping regions 142 of adjacent nozzles 122 and 132. Thus, the active vernier nozzles 125 may be adjacent to inert vernier nozzles 126 in the upper ejector module 122, and correspondingly, the inactive nozzles 133 may be adjacent to active nozzles 134 in the lower ejector module 132. Because of the orthogonal column disposition of the nozzles within their respective nozzle rows, a single pass checker-boarding printing technique may be used to reduce the effects of failed nozzles to acceptable levels.

This exemplary structure of the FWA print bar 100, with modules having double rows of 600 npi, enables both vernier technique to reduce alignment errors to an acceptable level and a single pass checker-boarding technique to reduce the effect of failed nozzles to an acceptable level.

The pitch of the nozzle spacing in the vernier nozzle series 124 may be readily selected to achieve the desired ≦10 μm target alignment tolerance. For example, the second alignment line 162 can be selected as an origin $x_0=0$ for the lateral direction 101. To the left of the origin, successive columns of active standard nozzles 123 of the upper ejector module 122 may be disposed at $x_{-n}=-na$, where a is the standard spacing (42 μm for 600 npi), and n is the number of columns from the origin. For example, the first alignment line 161 is positioned at $x_{-1}=-a$ for $n=-1$.

To the right of the origin, successive columns of vernier nozzles are disposed at $x_{+n}=n(a+\Delta v)$, where $\Delta v$ is the vernier difference (increase or decrease) from the standard spacing (12.5% as shown). For example, the sixth alignment line 166 is positioned at $x_4=4(a+\Delta v)$ for $n=4$. The vernier difference can be expressed as $\Delta v=a/M$, where M is a positive number. For the example described, M may be an integer.

Similarly, the column for the nearest inert nozzles 133 in the lower ejector module 132 to the right of the origin (labeled "prime") can be disposed at position $x'_0=b$. Successive columns of standard inert nozzles 133 to either the right or left sides of this position are disposed at $x'_{\pm n}=b\pm na$. For example, the fourth, fifth and sixth alignment lines are disposed at $x'_{-1}=b-a$, $x'_1=b+a$ and $x'_4=b+4a$, respectively. Thus, the sixth line 166 corresponds to $x_4=4(a+\Delta v)\approx x'_4=b+4a$ (within tolerance). The positions of successive nozzles in the upper and lower ejector modules 122 and 132 to the right of the origin (x>0) at the second alignment line 162 are then summarized as follows:

$$\text{Upper nozzles: } x=0,\ (a+\Delta v),\ 2(a+\Delta v),\ 3(a+\Delta v),\ 4(a+\Delta v), \tag{1}$$

$$\text{Lower nozzles: } x'=b,\ b+a,\ b+2a,\ b+3a,\ b+4a, \tag{2}$$

The spacing differences $\Delta x$ between nozzles in the upper and lower modules 122 and 132 that have adjacent columns to the right of the origin (x>0) may be determined by subtracting the upper values from equation (1) from the lower values from equation (2), or $\Delta x_n=x'_n-x_n$. For example, the first set of spacing differences listed above between $x_0=0$ and $x'_0=b$ is $\Delta x_0=b-0=b$.

Correspondingly, the second set of spacing differences between $x_1=a+\Delta v$ and $x'_1=b+a$ is $\Delta x_1=b+a-(a+\Delta v)=b-\Delta v$. Similarly, the third set of spacing differences between $x_2=2$ (a+Δv) and is $x'_2$=b+2a is $\Delta x_2$=b+2a−2(a+Δv)=b−2Δv, and so forth. This relation can be written in more general form as:

$$\Delta x_n = b - n\Delta v. \quad (3)$$

By spacing the upper and lower nozzles at different intervals, the spacing difference Δx between nozzles of adjacent modules reduces as n increases to a spacing value N until reaching an acceptable offset tolerance ϵ, such as for the sixth alignment line 166 at n=4. The tolerance ϵ corresponds to the human visual acuity for pixel spacings of ~10 μm. This spacing difference relation can be written in more general form as:

$$|\Delta x_N| = |b - N\Delta v| \leqq \epsilon. \quad (4)$$

Achieving the minimum value of positive number M for the acceptable tolerance ϵ, and hence the maximum vernier difference spacing Δv, requires that the difference spacing Δv not exceed twice the maximum allowable offset of 10 μm, labeled as a/m, where a is the nominal spacing between nozzles along a row (42 μm) and m is a ratio of tolerance and the nozzle spacing. Otherwise, the spacing differences Δx from where the lower nozzle is offset to the right of the upper nozzle to where the lower nozzle is offset to the left to the upper nozzle might not diminish to less than a/m. This requirement can be expressed as:

$$\Delta v = a/M < 2a/m \Rightarrow M > m/2. \quad (5)$$

For a=42 μm (600 dpi) and a/m=10 μm, then consequently m is approximately 4⇒M>m/2 is approximately 2, which is an easily achievable condition. In the example shown in FIG. 1, the vernier difference may be selected as Δv=a/M=a/8, so that the spacing value is chosen as M=8. Hence, a+Δv=1 ⅛a=1.125/600" should readily enable achieving alignment to better than the desired 10 μm. In a color ink jet printing device, this alignment must be achieved in the FWA print bar for each color, including cyan, magenta, yellow, black, and if applicable, a pre-conditioner and/or double-black.

The value of N represents the total number of nozzle columns from the chosen origin $x_0$=0 to achieve the desired offset tolerance, and may be determined from equation (4), which can be rewritten as:

$$|\Delta x_N| = |b - N\Delta v| = |b - Na/M| \leqq a/m. \quad (6)$$

The value of N depends on where the replacement module is positioned, i.e., on the offset value of position b. In the example shown in FIG. 1 for a worst-case scenario in which the nozzles at the end of the replacement lower module 132 may be disposed so that the fourth alignment line 164 straddles between the adjacent alignment lines 161 and 162 of the overlapping upper module 122. Substituting b=a/2, M=8, and a/m=10 μm into equation (6) yields:

$$|a/2 - Na/8| \leqq 10\ \mu m. \quad (7)$$

After rearranging the terms, and substituting a=42 μm for the exemplary spacing arrangement shown, the values of N may be determined by the relationship:

$$|1 - N/4| \leqq 20\ \mu m/a = 0.4762. \quad (8)$$

Solving for N within the absolute bounds of equation (8) yields a range of 2.1≦N≦5.9. The corresponding integer values for this example are thus N=3, 4 and 5 that would enable alignment of the integral column number of nozzles in the upper module 122 with a column of nozzles in the lower module 132 to spacing differences between these columns within the acceptable tolerance of 10 μm.

For these values of N, the spacing differences between the upper and lower columns may be expressed as:

$$\Delta x_N = b - N\Delta v = a/2 - Na/8 = \begin{cases} 5.25 \\ 0 \\ -5.25 \end{cases} \quad (9)$$

$$\text{for } N = \begin{cases} 3 \\ 4 \\ 5 \end{cases}.$$

All of these spacing difference values are within the tolerance requirement of 10 μm. The value of N=4 was selected to illustrate the alignment of the upper and lower columns of nozzles in FIG. 1 to illustrate the optimal spacing difference of zero for perfect alignment, and generally preferred over the differences of ~±5 μm for N=3 or 5.

Figure 2:
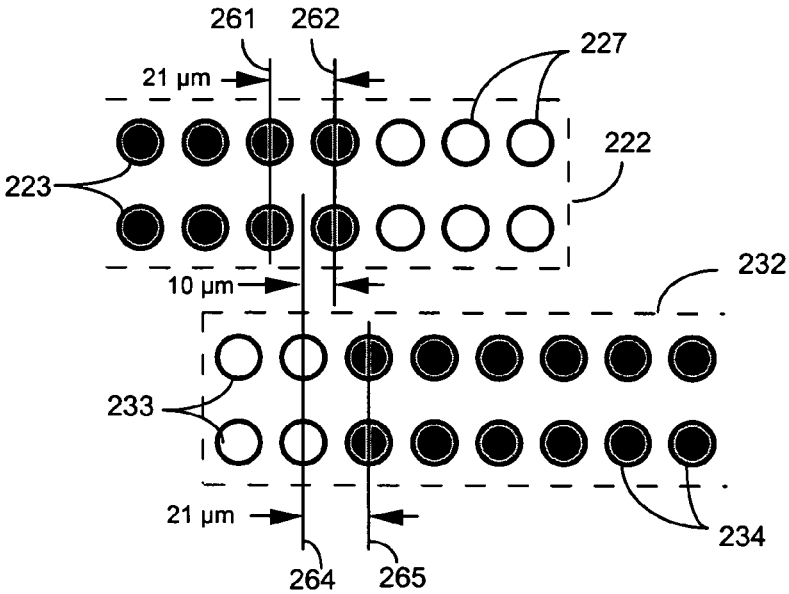
FIG. 2 shows a first exemplary comparative nozzle configuration.

Other options for achieving this degree of alignment and for mitigating the effects of missing nozzles are shown in FIGS. 2 through 5 using modules with a designed tolerance for a particular nozzles-per-inch (npi) value. These other options have respective disadvantages especially as compared to the exemplary technique described hereafter:

(1) Fabricate 2400 npi in-line jet modules to enable both ±10 μm alignment and single pass checker-boarding, as shown in FIG. 2. However, such technology is not currently available, or will likely be expensive and/or difficult to maintain operational if this technique becomes available subsequently.

Figure 3:
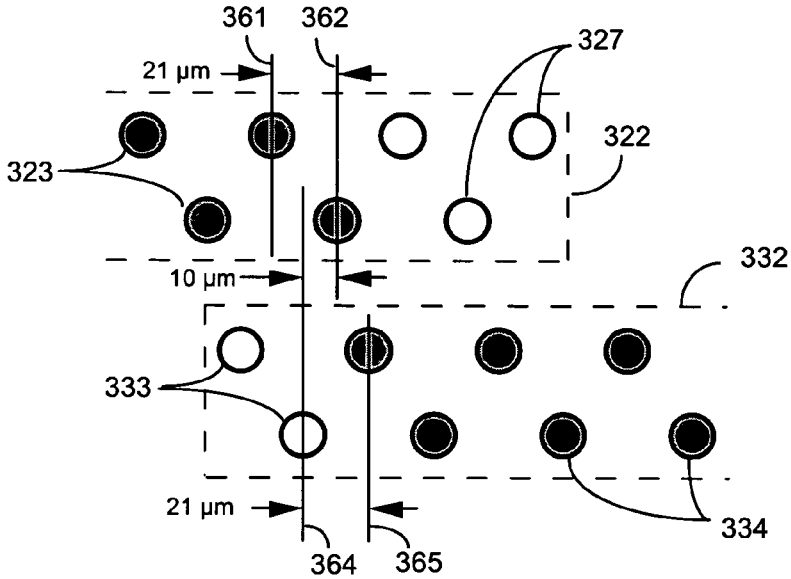
FIG. 3 shows a second exemplary comparative nozzle configuration.

(2) Fabricate 1200 npi staggered jet modules to enable ±10 μm alignment, as shown in FIG. 3. However, while this form of 1200 npi technology (with rows of 600 npi each) is currently on the market, this option does not permit single pass checker-boarding.

Figure 4:
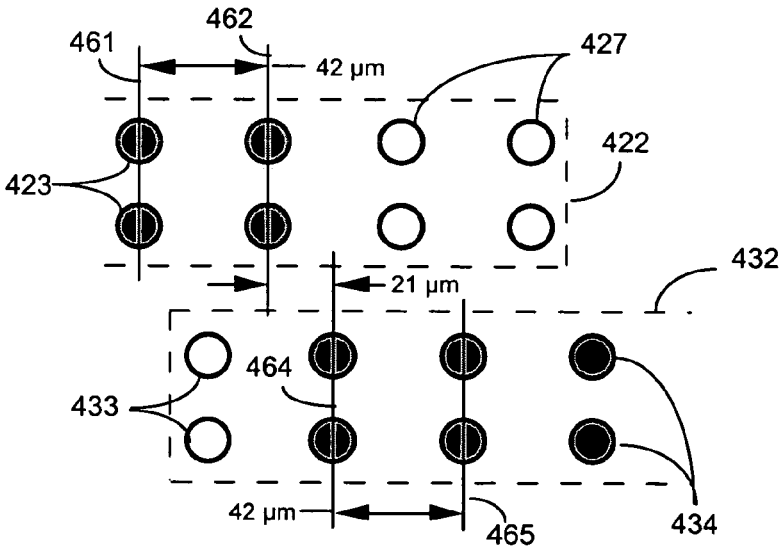
FIG. 4 shows a third exemplary comparative nozzle configuration.

(3) Fabricate 1200 npi in-line jet modules at 600 dpi drop size to enable single pass checker-boarding, as shown in FIG. 4. However, this option does not enable ±10 μm alignment.

Figure 5:
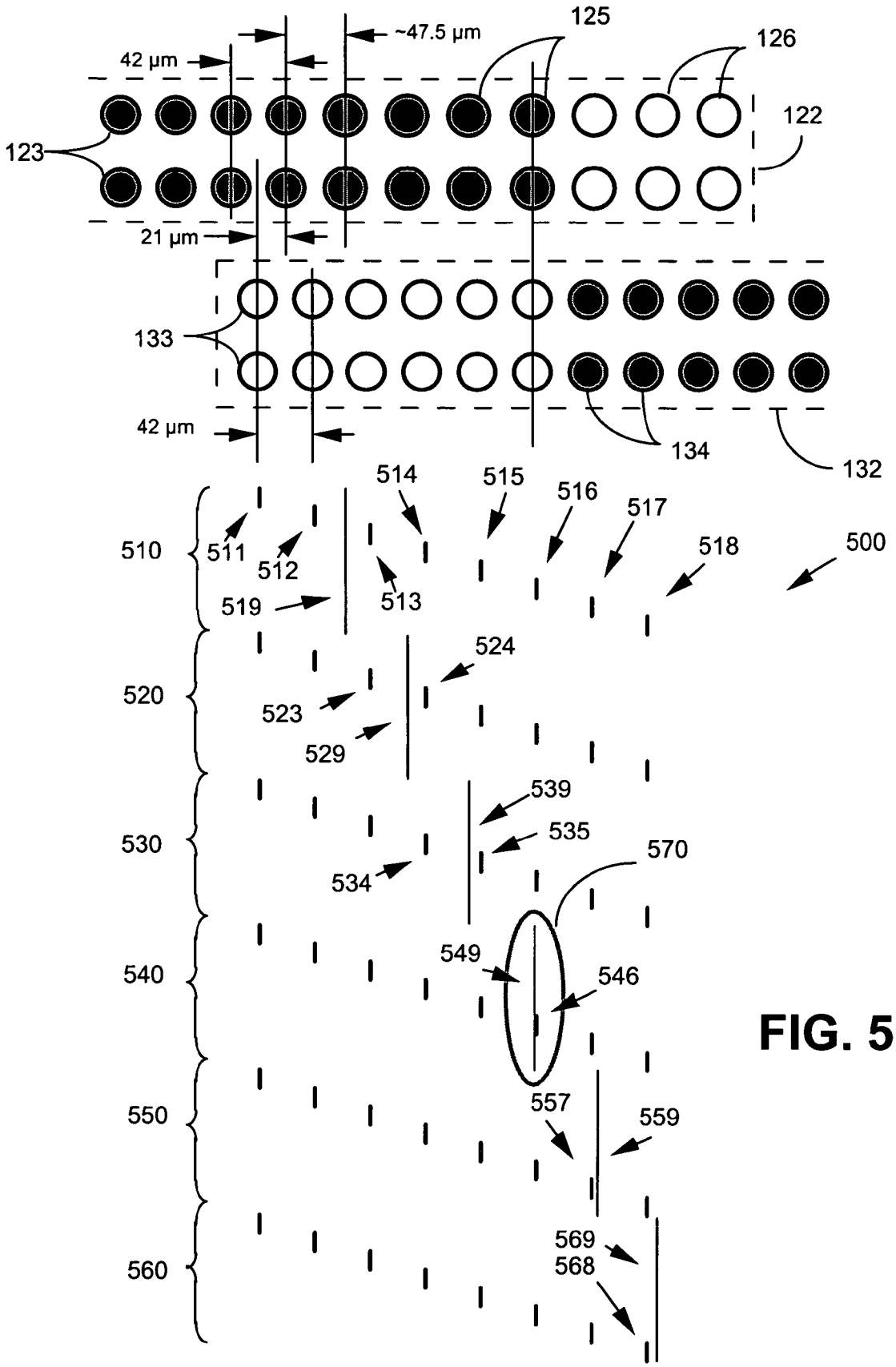
FIG. 5 shows a fourth exemplary nozzle configuration with alignment comparison patterns.

(4) Fabricate 1200 npi in-line jet modules with slightly expanded or reduced nozzles or spacings to enable both ±10 μm alignment and single pass checker-boarding, as shown in FIG. 5.

The first option, shown in FIG. 2 for comparative purposes, features nozzles spaced 21 μm apart. Upper and lower ejector modules 222 and 232 are disposed to overlap each other. The upper ejector module 222 includes active nozzles 223 and inert nozzles 227 in two parallel rows in tandem pairs disposed orthogonal to the nozzle rows. The lower ejector module 232 includes active nozzles 233 and inert nozzles 234 in two parallel rows in tandem pairs disposed orthogonal to the nozzle rows.

FIG. 2 shows the uniform spacing between upper nozzles 223 and 227, exemplified by first and second alignment lines 261 and 262 as 21 μm. Similarly, third and fourth alignment lines 264 and 265 illustrate the uniform spacing between lower nozzles 233 and 234 as 21 μm. The maximum spacing between the upper active nozzles 223 and the lower inert nozzles 233, as shown by the second and third alignment lines 262 and 264 is 10 μm. Unfortunately, this configuration is not currently available in practice.

The second option, shown in FIG. 3 for comparative purposes, features staggered nozzles spaced 42 μm apart. Upper and lower ejector modules 322 and 332 are disposed to overlap each other. The upper ejector module 322 includes active nozzles 323 and inert nozzles 327 in two parallel rows in staggered pairs disposed diagonal to the nozzle rows. The lower ejector module 332 includes active nozzles 333 and inert nozzles 334 in two parallel rows in staggered pairs disposed diagonal to the nozzle rows.

FIG. 3 shows the uniform spacing between alternating rows of upper nozzles 323 and 327, exemplified by first and second alignment lines 361 and 362 as 21 μm. Similarly, third and fourth alignment lines 364 and 365 illustrate the uniform spacing between alternating rows of lower nozzles 333 and 334 as 21 μm. Within their respective rows, however, the spacing between nozzles is double this value, or 42 μm. The maximum spacing between the upper active nozzles 323 and the lower inert nozzles 333, as shown by the second and third alignment lines 362 and 364 is 10 μm. Unfortunately, although this configuration enables alignment tolerances of not more than 10 μm, this option does not enable single pass checker-boarding because every pixel row in the process direction 102 is addressed by only one nozzle.

The third option, shown in FIG. 4 for comparative purposes, features nozzles spaced 42 μm apart. Upper and lower ejector modules 422 and 432 are disposed to overlap each other. The upper ejector module 422 includes active nozzles 423 and inert nozzles 427 in two parallel rows in tandem pairs disposed orthogonal to the nozzle rows. The lower ejector module 432 includes active nozzles 433 and inert nozzles 434 in two parallel rows in tandem pairs disposed orthogonal to the nozzle rows.

FIG. 4 shows the uniform spacing between upper nozzles 423 and 427 that is exemplified by first and second alignment lines 461 and 462 as 42 μm. Similarly, third and fourth alignment lines 464 and 465 illustrate the uniform spacing between lower nozzles 433 and 434 as 42 μm. The maximum spacing between the upper active nozzles 423 and the lower inert nozzles 433, as shown by the second and third alignment lines 462 and 464, is 21 μm. Unfortunately, this configuration, although currently produceable and capable of single-pass checker-boarding, limits alignment tolerances to 21 μm, which is generally not acceptable.

The fourth option, using the above-described vernier technique for enabling the configuration shown in FIGS. 1 and 5, enables both ±10 μm alignment between active nozzles of the same color needed for single pass printing while simultaneously enabling single pass checker-boarding. The vernier technique facilitates use of an undemanding replaceable module strategy that requires only about five minutes for module disposition, with nozzle and timing selections from established printing patterns. The checker-boarding feature enables masking of malfunctioning nozzles. Further, the customer has the option of replacing a single ejector module if not satisfied with print quality, instead of the entire print bar array.

Once the printhead ejector module has been replaced, there are several ways for simple customer selection of the active nozzles to be used at the junction between the replaced ejector module and its neighbors. One such way involves manual or scanned review of printed lines from the upstream and downstream rows 120 and 130. FIG. 5 shows printing test patterns 500 composed of line segments printed in the process direction 102 and across the medium in the lateral direction 101 (shown in FIG. 1).

These line segments are printed for the various options for selecting the nozzle arrangement having the best alignment. Longer lines are printed in sequence by the first several active and inert vernier nozzles 125 and 126 in the upper ejector module 122. Shorter lines are printed from the candidate nozzles 133 and 134 in the lower ejector module 132, including the standard nozzles 133 that are ultimately to be rendered inert, and the standard nozzles 134 to be selected as active. The boundary in the lower ejector module 132 between inert and active nozzles is assigned to align with a selected column of active vernier nozzles 125 in the upper ejector module 122. This boundary denotes the demarcation between active nozzles for print actuation on command and inert nozzles that remain idle.

The line segments are printed in a patterned plurality of sequences 510,520, 530, 540, 550 and 560. The first sequence 510 includes short segments 511, 512, 513, 514, 515, 516, 517 and 518 from the nozzles 133 and 134 of the lower ejector module 132 and a long segment 519 from the farthest left of the active vernier nozzles 125 of the upper ejector module 122. In the first sequence 510, the long segment 519 is disposed about midway between the short segments 512 and 513.

In the second sequence 520, a long segment 529 from the first-from-farthest left of the vernier nozzles 125 is disposed between short segments 523 and 524. In the third sequence 530, a long segment 539 from the second-from-farthest-left of the vernier nozzles 125 is disposed between short segments 534 and 535, but much closer to the latter than to the former. In the fourth sequence 540, a long segment 549 from the farthest right of the active vernier nozzles 125 is disposed almost directly over or adjacent to a short segment 546.

In the fifth sequence 550, a long segment 559 from the farthest left of the inert vernier nozzles 126 is disposed between short segments 557 and 558, but much closer to the former than the latter. In the sixth sequence 560, a long segment 569 from first-from-farthest-left of the inert vernier nozzles 126 is disposed to the right of a short segment 568. A cursory glance reveals that the fourth sequence 540 provides the best alignment of the printing sequences shown. An oval 570 identifies the long segment 549 near the short segment 546. Such identification can be performed either manually or by means of automatic scanning. Selection of the appropriate sequence can be performed via radio buttons, for example, or any other suitable technique.

The best alignment match of the shorter lines to the long lines are chosen either by a scanner of by the customer's visual observation. The active nozzles are then selected from the best aligned pair of nozzles in the two modules by selecting one of these pair and then selecting all nozzles to the right of this pair in the module extending to the right and by selecting all of the nozzles to the left of this pair in the module extending to the left. In this manner, the nozzles and their active/inert boundaries can be established without requiring physical translation of the newly installed ejector module to be aligned.

Figure 6:
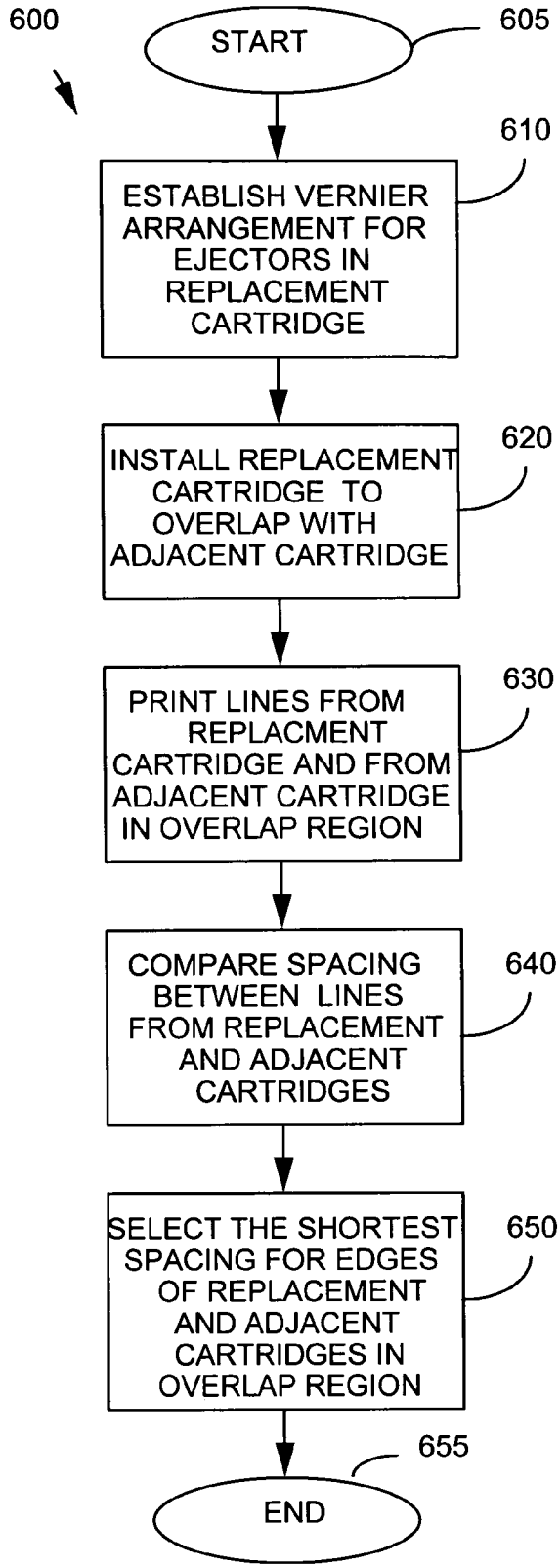
FIG. 6 shows an exemplary flowchart of a method for aligning a replacement cartridge.

FIG. 6 shows an exemplary flowchart 600 of a method for aligning a replacement cartridge relative to an adjacent cartridge with which the replacement cartridge shares an overlap region. The method begins at step S605 and proceeds to establish a vernier arrangement of ejectors in at least one of either the replacement cartridge and/or the adjacent cartridge at step S610. The replacement cartridge is installed at step S620 to form an overlap region with the adjacent cartridge.

The process continues to step S630, where print lines from the replacement and adjacent cartridges are printed in the overlap region. The process continues to step S640, in which the spacing between lines from the respective cartridges are compared. Then, the nozzles producing the lines corresponding to the shortest spacing are selected as the edges for the replacement and adjacent cartridges at step S650. The process then terminates at end step S655.

Alignments of nozzles for the ejector modules are necessary to select the boundaries between active and inert nozzles in the overlapping region 142, and can be accomplished or facilitated by the vernier technique. Such selections for modules can be performed in the same color print bar, and the vernier technique can also be employed for module-to-module alignment in the cross process direction. As noted above, color nozzles should also be aligned to the black nozzles and to the other color nozzles in both the process direction 102 and in the lateral direction 101.

As mentioned above, the vernier can be created either by slightly oversized or slightly undersized jets. If slightly oversized nozzles are used, then slight image expansion occurs over these jets. If slightly undersized nozzles are used, then slight image contraction occurs over these jets. To avoid any slight net image expansion or contraction, it may be helpful to use a vernier arrangement with slightly oversized nozzles on half of the modules (e.g. on the upstream row 120) and slightly undersized nozzles on the other half of the modules (e.g. on the downstream row 130).

While this invention has been described in the conjunction with exemplary implementations outlined above, many alternatives, modifications and variations are possible. Accordingly, the exemplary implementations, set forth above, are intended to be illustrative, not limiting.

What is claimed is:

1. A method for aligning a replacement ejector module with other ejector modules in a printhead array along a lateral direction, the ejector modules having nozzles that eject fluid on command, the method comprising:

replacing a first replaceable ejector module or a second replaceable ejector module without replacing other ejector modules in the printhead array, arranging a first plurality of nozzles within the first module, the first plurality of nozzles including a first spacing between adjacent first nozzles along the lateral direction;

arranging a second plurality of nozzles at one end of the second module, the second plurality of nozzles including a second spacing between adjacent second nozzles that differs from the first spacing along the lateral direction, the second plurality of nozzles partially overlapping the first plurality of nozzles in the lateral direction at the one end;

determining an alignment pair between a first alignment nozzle of the first plurality of nozzles and a second alignment nozzle of the second plurality of nozzles, the first and second alignment nozzles minimizing an alignment spacing between each other as compared to remaining nozzles of the first and second pluralities of nozzles; and assigning the first and second alignment nozzles as first and second boundaries for print actuation, wherein determining the alignment pair further comprises:

printing first lines from the first plurality of nozzles, printing second lines from the second plurality of nozzles, comparing distances between pairs of adjacent first and second lines, and selecting a pair of the adjacent first and second lines having a minimum distance therebetween.

2. The method according to claim 1, wherein arranging the second plurality of nozzles further includes sizing the second nozzles to differ from the first nozzles in conjunction with the second and first spacings.

3. The method according to claim 1, wherein at least one of the first and second pluralities of nozzles forms a plurality of adjacent rows along the lateral direction, each row having a first row nozzle disposed orthogonal to a second row nozzle of an adjacent row, whereby to achieve single pass checker-boarding.

4. The method according to claim 1, wherein the second spacing is larger than the first spacing.

5. The method according to claim 1, wherein the second spacing is smaller than the first spacing.

6. The method according to claim 1, arranging the second plurality further comprises:

setting the second spacing to be larger than the first spacing; and sizing the second nozzles to be correspondingly larger than the first nozzles.

7. The method according to claim 1, arranging the second plurality of nozzles further comprises:

setting the second spacing to be smaller than the first spacing; and sizing the second nozzles to be correspondingly smaller than the first nozzles.

8. A machine-readable storage medium having executable software code for aligning an ejector module in a printhead array along a lateral direction, the ejector module having nozzles that eject fluid on command, the software code comprising:

instructions for arranging a first plurality of nozzles within a first replaceable ejector module, the first plurality of nozzles including a first spacing between adjacent first nozzles along the lateral direction;

instructions for arranging a second plurality of nozzles at one end of a second replaceable ejector module, the second plurality of nozzles including a second spacing between adjacent second nozzles that differs from the first spacing along the lateral direction, the second plurality of nozzles partially overlapping the first plurality of nozzles in the lateral direction at the one end, the first and second modules being replaceable without replacing other ejector nozzles in the printhead array;

instructions for determining an alignment pair between a first alignment nozzle of the first plurality of nozzles and a second alignment nozzle of the second plurality of nozzles, the first and second alignment nozzles minimizing an alignment spacing between each other as compared to remaining nozzles of the first and second pluralities of nozzles; and instructions for assigning the first and second alignment nozzles as first and second boundaries for print actuation, wherein the instructions for determining the alignment pair further comprise:

instructions for printing first lines from the first plurality of nozzles, instructions for printing second lines from the second plurality of nozzles, instructions for comparing distances between pairs of adjacent first and second lines, and instructions for selecting a pair of the adjacent first and second lines having a minimum distance therebetween.

9. The machine-readable storage medium according to claim 8, wherein arranging the second plurality of nozzles further includes sizing the second nozzles to differ from the first nozzles in conjunction with the second and first spacings.

10. The machine-readable storage medium according to claim 8, wherein at least one of the first and second pluralities of nozzles forms a plurality of adjacent rows along the lateral direction, each row having a first row nozzle disposed orthogonal to a second row nozzle of an adjacent row, whereby to achieve single pass checker-boarding.

11. The machine-readable storage medium according to claim 8, wherein the second spacing is larger than the first spacing.

12. The machine-readable storage medium according to claim 8, wherein the second spacing is smaller than the first spacing.

13. The machine-readable storage medium according to claim 8, arranging the second plurality of nozzles further comprises:

instructions for setting the second spacing to be larger than the first spacing; and instructions for sizing the second nozzles to be correspondingly larger than the first nozzles.

14. The machine-readable storage medium according to claim 8, arranging the second plurality of nozzles further comprises:

instructions for setting the second spacing to be smaller than the first spacing; and instructions for sizing the second nozzles to be correspondingly smaller than the first nozzles.

15. An apparatus for aligning an ejector module in a printhead array along a lateral direction, the ejector module having nozzles that eject fluid on command, the apparatus comprising:

a first plurality of nozzles within a first replaceable ejector module, the first plurality of nozzles including a first spacing between adjacent first nozzles along the lateral direction;

a second plurality of nozzles at one end of a second replaceable ejector module, the second plurality of nozzles including a second spacing between adjacent second nozzles that differs from the first spacing along the lateral direction, the second plurality of nozzles partially overlapping the first plurality of nozzles in the lateral direction at the one end, the first and second modules being replaceable without replacing other ejector nozzles in the printhead array;

an alignment determiner that determines an alignment pair between a first alignment nozzle of the first plurality of nozzles and a second alignment nozzle of the second plurality of nozzles, the first and second alignment nozzles arranged to minimize an alignment spacing between each other as compared to remaining nozzles of the first and second pluralities of nozzles;

a print actuator that establishes first and second boundaries for print actuation assigned by the first and second alignment nozzles;

a distance comparer that compares distances between pairs of adjacent first and second lines after printing first and second lines from the first and second pluralities of nozzles, respectively; and a selector for selecting a pair of the adjacent first and second lines having a minimum distance therebetween.

16. The apparatus according to claim 15, wherein the first nozzles have a first size that differs from the second nozzles in relative conjunction with the first and second spacings.

17. The apparatus according to claim 15, wherein at least one of the first and second pluralities of nozzles forms a plurality of adjacent rows along the lateral direction, each row having a first row nozzle disposed orthogonal to a second row nozzle of an adjacent row, whereby to achieve single pass checker-boarding.

* * * * *